US006370925B1

(12) United States Patent
Akashi et al.

(10) Patent No.: US 6,370,925 B1
(45) Date of Patent: Apr. 16, 2002

(54) FASTENING DEVICE WITH TAPE

(75) Inventors: Shunji Akashi; Kiyomasa Segawa, both of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/482,206

(22) Filed: Jan. 12, 2000

(30) Foreign Application Priority Data

Jan. 29, 1999 (JP) ..... 11-022490

(51) Int. Cl.[7] ..... D04B 23/08
(52) U.S. Cl. ..... 66/195; 66/197
(58) Field of Search ..... 24/392, 393; 66/190, 66/193, 195, 192, 196

(56) References Cited

U.S. PATENT DOCUMENTS

| | | | | | |
|---|---|---|---|---|---|
| 4,228,566 | A | * | 10/1980 | Matsuda | 66/195 |
| 4,378,683 | A | * | 4/1983 | Matsuda et al. | 66/195 |
| 4,805,272 | A | * | 2/1989 | Yamaguchi | 24/623 |
| 5,586,454 | A | * | 12/1996 | Matsuda et al. | 24/623 |
| 6,076,377 | A | * | 6/2000 | Ta-An | 66/195 |
| 6,282,926 | B1 | * | 9/2001 | Matsuda et al. | 66/192 |

FOREIGN PATENT DOCUMENTS

| | | |
|---|---|---|
| DE | 2 200 444 | 7/1973 |
| EP | 0 228 293 | 7/1987 |
| EP | 0 943 255 | 9/1999 |
| FR | 2 413 490 | 7/1979 |

* cited by examiner

*Primary Examiner*—Danny Worrell
(74) *Attorney, Agent, or Firm*—Finnegan, Henderson, Farabow, Garrett & Dunner, L.L.P.

(57) ABSTRACT

In a fastening device with tape, made of synthetic resin, the tape is composed of a warp knitting structure including an attachment area composed of one or more wales disposed at the right and left edge portions in a width direction of the tape, and a fastener-molding area composed of plural wales in a center portion in the width direction of the tape. The warp knitted tape is entirely composed of a knitting structure by tangling of two needle stitch yarns and weft in-laid yarns. A chain stitch yarn is further knitted into the attachment area so as to suppress the stretching property an stabilize dimensional form in the warp direction of the attachment area. In the fastener-molding area, a predetermined stretching property in the warp direction and some extent of stability in dimensional form are secured. The fastening device can be adapted well to an attachment object such as clothes having a stretching property and may be engaged or disengaged securely and accurately. Further, continuous smooth molding of the device can be enabled, and an attachment performance to clothes by sewing can be smoothly carried out.

5 Claims, 8 Drawing Sheets

FASTENING DEVICE WITH TAPE

BACKGROUND OF THE INVENTION

1. Field of the Invention

The present invention relates to a fastening device with tape to which a fastener such as a male or female snap fastener made of thermoplastic resin material is integrally molded on and through front and rear surfaces of the tape. More particularly, it relates to a fastening device with tape which is a knitted tape having flexibility, some extent of stretching property, and form stability, and is ensured in dimensional stability during molding, and which can be attached to an attachment object with stability by sewing and is capable of following stretch of the attachment object sufficiently.

2. Description of the Related Art

Most tapes to be used for a fastening device with tape, to which a fastener made of thermoplastic synthetic resin is attached integrally to the tape, are fabric woven with non-strechable warp and weft yarns. The reason is that when the fasteners such as snap fasteners and eyelets are molded on a tape or the fastening device with tape is attached to an attachment object such as clothes, bag, curtain or the like, stability of the tape form is secured. Therefore, in general, the fastening device with tape has a low stretching property.

A production method for such a fastening device with tape has been disclosed in, for example, the U.S. Pat. No. 2,821,764. According to the production method, for a purpose of ensuring an excellent joining force between the tape and a grommet, a plurality of small holes are made around a mounting hole which is for mounting the grommet and inserting a tape, and the grommet to be molded integrally on front and rear surfaces of the tape through the mounting hole is fixed firmly with leg portions formed through those small holes. According to a specification of the U.S. patent, in order to prevent waving of a peripheral portion around the mounting hole of the tape or displacement of the tape in directions of the front and rear surfaces thereof, a plurality of pin members are provided inside a grommet-molding cavity formed in a movable die and a fixed die such that they are protruded into portions in which the peripheral portion around the mounting hole of the tape is inserted from each of inner faces of the cavities so as to oppose each other. Then, the peripheral portion around the mounting hole of the tape is clamped by the pin members. Under this condition, molten resin material is injected so as to mold the eyelet integrally around the mounting hole of the tape. Such a structure for preventing the waving has been also applied to a production method for a snap fastener with tape, which is disclosed in, for example, Japanese Patent Laid-Open Publication No. 62-155805.

According to Japanese Utility Model Laid-Open Publication No. 56-16311 and Japanese Patent Laid-Open Publication No. 10-33211, the tape is composed of woven fabric or knitted fabric, a fastener molding portion formed in a center in a width direction of the tape is formed by weaving or knitting coarsely, at least, and the snap fastener is molded integrally on that center portion. In this case, the mounting holes are not made in the fastener molding portion as in the aforementioned U.S. patent, but the snap fastener is molded integrally on the front and rear surfaces of the tape by introducing molten resin material through gaps between yarns woven or knitted coarsely in the tape.

The aforementioned synthetic resin fastening device with tape, which substitutes for a conventional fastening device with tape to which a metallic fastener is attached, is excellent to the touch as well as productivity. Thus, this is not only applied to the fastening devices in outer wears, various bags or the like, but also often used for foundation, inner wear, baby clothes, medical clothes or the like, which directly contacts the skin of man's body. On the other hand, recently, various fabric materials have been developed to meet diversified fashions. For example, there are used outer wear having a stretching property, various kinds of clothes made of fabric material having softness and an appropriate stretching property, knitted fabric or the like are used.

Usually, a woven tape as mentioned above is used for a tape of a synthetic resin fastening device with tape which is applied to clothes to be directly in contact with man's skin like foundation or the clothes made of peculiar fabric material. However, the woven fabric tape does not fit to such soft clothes having ample stretching property, so that it is likely to move individually between the clothes and the fasteners. Therefore, when the fastening device is engaged or disengaged, it is difficult to join a male and a female fasteners with fingers, or a finger force of the operation is difficult to transmit to each of the fasteners. As a result, it takes a long time to engage or disengage the both fasteners.

Even if, a flexible, thin woven tape is used, excellent stretching property cannot be expected. When this kind of the woven tape is attached to stretchable clothes or along a curved portion of the clothes, the tape is not capable of following the stretching of the stretchable clothes, the tape is wrinkled when it is sewn to the curved portion, or the curved portion of the sewing portion loses its shape.

As a tape material for a fastening device with tape which is suitable for attachment to a curved portion, Japanese Utility Model Publication No. 3040449 proposes use of bias woven fabric which is obtained by cutting warp and weft in-laid yarns obliquely at a predetermined angle. However, in the bias woven fabric, the yarns tend to be frayed at a cut end thereof. Therefore, according to the registered utility model, both edge portions in the width direction of the tape is folded back toward its center, and the synthetic resin snap fastener is molded integrally between those opposing edge portions.

Although use of a knitted tape has been described in the above mentioned Japanese Utility Model Laid-Open Publication No. 56-16311 and Japanese Patent Laid-Open Publication No. 10-33211, its concrete tape structure relating to a knitting structure, thickness of yarn to be used or the like has not been concretely proposed. In the synthetic resin fastening device with tape using the bias woven fabric tape as disclosed in the Japanese Utility Model Publication No. 3040449, no concrete method has been disclosed about a production method for the synthetic resin fastening device with tape, particularly a molding method for the fastening device.

Conventionally, as a tape material for the synthetic resin fastening device with tape of this kind, many attempts have been carried out in order to use stretchable tapes, such as a knitted tape using a stretching property based on its knitting structure, a woven tape using stretchable yarns as constitutive yarns of warp yarns. However, because many problems, that will occur when the synthetic resin fasteners are molded integrally on the tape, have not been overcome as described later, these tapes have not been reduced to practice. Even when the knitted tape is used, it is not capable of securing form stability as well as the woven tape. In order to secure this form stability, it is necessary to suppress that stretching property completely by, for example, coating the knitting structure. However, when the stretching property is suppressed completely, proper flexibility and stretching property of the knitted fabric are not exerted so that the above requirement cannot be satisfied.

In general, in production of this kind of synthetic resin fastening device with tape, a tape is inserted into a tape insertion passage in upper and lower dies formed with a molding cavity for molding a fastener, at facing portions thereof, and thermoplastic synthetic resin is injected into the cavity in molten state so as to mold the fastener on front and rear surfaces of the tape, as described above. In order to mold the fastener on the front and rear surfaces of the tape, generally a fastener-mounting hole is made in the center portion in the width direction of the tape, or the tape is knitted with a coarse knitting structure, in case where the molten resin is introduced into the cavity in the upper and lower dies disposed so as to sandwich the front and rear surfaces of the tape.

The aforementioned fastener is molded integrally by injecting molten resin material successively at a predetermined pitch to a long tape being transferred between the upper and lower dies intermittently. Mounting positions of the male and female fasteners on each tape need to be precise enough to correspond to each other in the synthetic resin fastening device with tape which acts in a pair as the male and female fastening device with tape as a product. That is, an error in pitch between the plural fasteners molded on the tape should be avoided.

However, although in case of the knitted fabric having stretching property, some extent of stretching property may be obtained easily due to its structure, it is difficult to obtain form stability which is a conflicting function to the stretch property. Thus, to mold plural fasteners continuously at an accurate pitch on front and rear surfaces of a knitted tape, not only a highly accurate control on a tape tension, transfer speed but also high positioning accuracy is required. To satisfy these requirements, a highly accurate control technology and equipment for such flexible material are necessary. However, even when these are technologically possible to be achieved, they cannot be carried out in economical viewpoints.

SUMMARY OF THE INVENTION

Accordingly, the present invention has been achieved to solve these problems, and therefore an object of the invention is to provide a fastening device with tape, which is a warp knitted tape having dimensional stability and some extent of stretching property, which can be engaged or disengaged securely even when the device with tape is attached to stretchable clothes, and which enables continuous molding of a plurality of fasteners integrally on the tape at a highly accurate pitch by using a conventional production equipment.

To achieve the above objects, according to a first aspect of the invention, there is provided a fastening device with tape obtained by molding a fastener such as a snap fastener made of thermoplastic synthetic resin integrally on front and rear surfaces of a tape, wherein the tape is composed of a warp knitting structure in which plural wales are disposed in a width direction of the tape, an area formed of one or more wales disposed on right and left edge portions in the width direction of the tape is an attachment area to an attachment object, an area formed of plural wales in a center in the width direction of the tape is a fastener-molding area, the attachment area has a knitting structure stabilized in dimensional form while stretch in a warp direction of the tape are suppressed, and the fastener-molding area has a knitting structure having a required stretching property in the warp direction and some extent of stability in dimensional form.

In the fastening device with tape of the present invention, the warp knitted tape whose attachment area to the attachment object has the aforementioned knitting structure having no stretching property in the warp direction is used. Even when the fasteners are molded integrally continuously at a predetermined pitch in a longitudinal direction of the warp knitted tape, no special disadvantage occurs in positioning the warp knitted tape being intermittently transferred. Even when an ordinary tape-transfer apparatus which has been used for a conventional woven fabric tape is used, highly accurate positioning and transferring are enabled.

If the fastening device with tape of the present invention is sewn to and along an opening/closing portion of clothes or the like as the attachment object, because the sewing line exists within the attachment area, no disadvantage by the sewing occurs when the tape stretches, so that neat sewing is possible. On the other hand, in the fastener-molding area in the center in the width direction of the warp knitted tape, the warp knitted tape keeps its original stretching property in the warp direction. Therefore, it follows the stretch of the clothes although it exists between the sewing lines. As a result, the male and female fasteners can be engaged or disengaged easily with fingers and the finger force may be transmitted securely to the fasteners, thereby achieving smooth engaging/disengaging operation.

According to a second aspect of the invention, there is further provided a fastening device with tape, wherein the warp knitted tape is entirely composed of a knitting structure formed by tangling of a two needle stitch yarn and a weft in-laid yarn, and a chain stitch yarn is knitted in the attachment area. Generally, stretching property is suppressed in a direction in which the sinker loop extends in a warp knitting structure. Although the sinker loop extends in both warp and weft directions in case of two needle stitch, its knitting line is formed in zigzag shape in the warp direction so that the stretch in the weft direction is suppressed largely, but some extent of the stretching property is ensured in the warp direction. Further, in case of the weft in-laid yarn inserted such that it is swung largely to the right and left, the stretching property in the warp direction is hardly suppressed and the dimensional form in the weft direction is stabilized. On the other hand, in case of the chain stitch yarn, the sinker loop extends only in the warp direction, so that it suppresses the stretching property most in the warp direction in the warp knitting structure.

According to a third aspect of the present invention, a yarn thicker than the other yarns is used for the chain stitch yarn disposed in the outermost wales in the attachment area. This not only makes dense knitting lines at the outermost sides of the attachment area but also suppresses its stretching property in the warp direction. As a result, the dimensional form in both the warp and weft directions is stabilized.

According to a fourth aspect of the present invention, the warp knitted tape is entirely composed of a knitting structure formed by tangling of a two needle stitch yarn and a weft in-laid yarn, and a yarn thicker than the other yarns is used for the two needle stitch yarn disposed at the outermost wales in the attachment area. That is, the same stretching property as the fastener-molding area is reserved in the attachment area except the outermost two wales. The outermost two wales are composed of the same structure as the other knitting structure but a yarn thicker than the other knitting yarns are used for the two needle stitch yarn there so as to make denser knitting line, thereby suppressing the stretching property in the warp direction. With such a structure, the above described operation and effect can be expected.

According to a fifth aspect of the present invention, there is provided a fastening device with tape wherein a further weft in-laid yarn is inserted in zigzag shape in the warp direction on two wales in the attachment area. By adding the weft in-laid yarn to the attachment area, the stretching property in the weft direction is effectively suppressed in the attachment area, thereby securing the dimensional stability both in the warp direction and the weft direction.

DESCRIPTION OF THE EMBODIMENTS

Hereinafter, the embodiments of the present invention will be described in detail with reference to the accompanying drawings.

Figure 1:
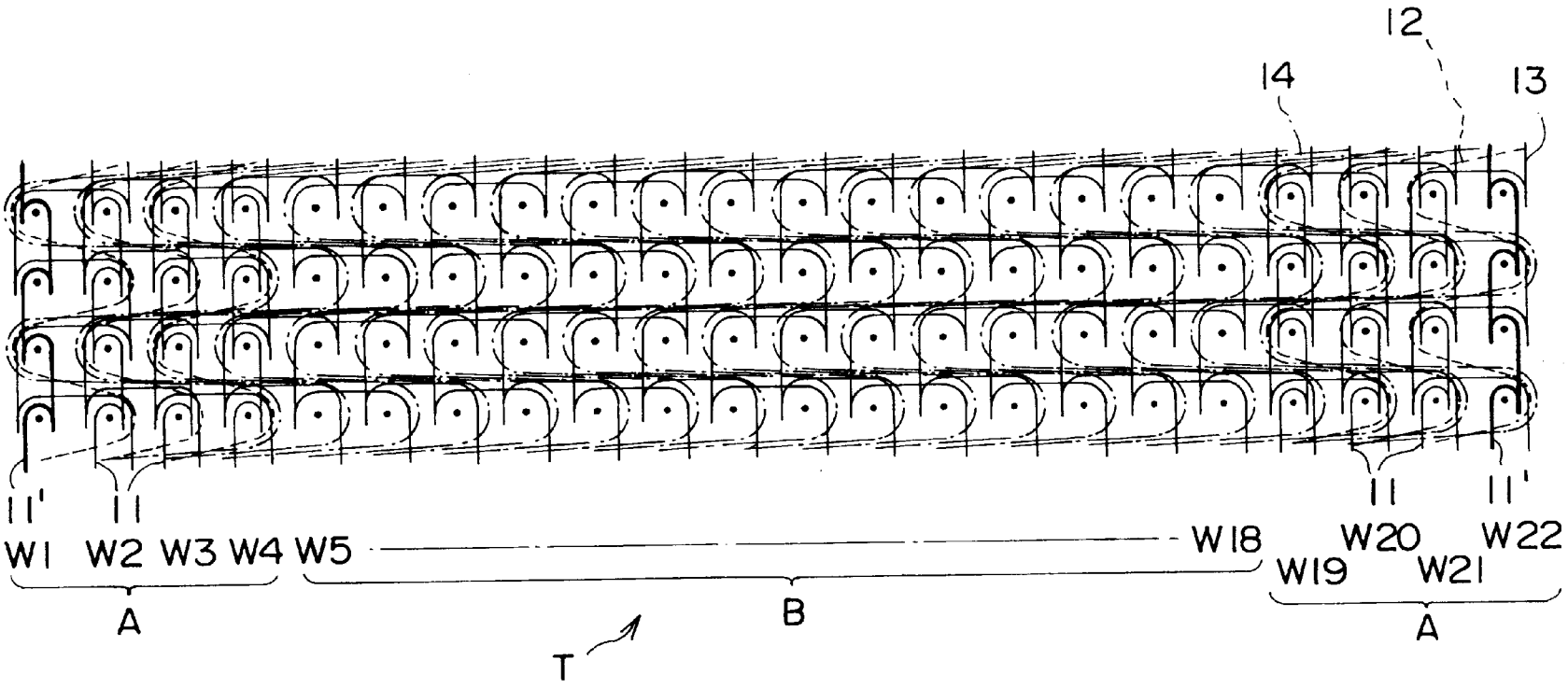
FIG. 1 is a diagram showing a knitting structure of a typical warp knitted tape applicable to a fastening device with tape of the present invention.
Figure 2:
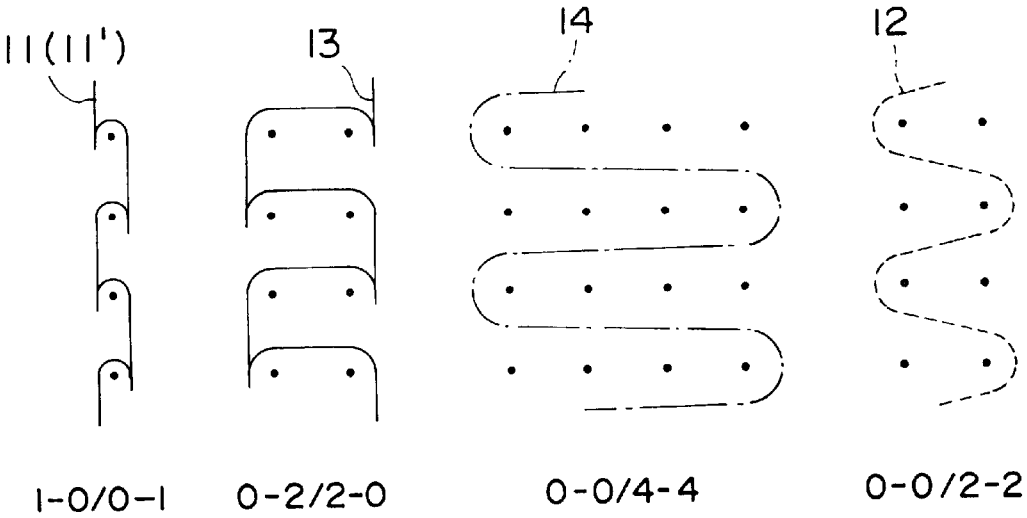
FIG. 2 is a diagram showing a knitting structure of each yarn of the warp knitted tape.

FIG. 1 is a diagram showing a knitting structure of a tape having a typical warp knitting structure which is to be applied to a fastening device with tape of the present invention, and FIG. 2 shows a knitting structure of each knitting yarn of the warp knitted tape.

Referring to FIG. 1, a warp knitted tape T formed of warp knitting structure is a narrow-width warp knitted tape formed of 22 wales $W_1$–$W_{22}$. Four wales $W_1$–$W_4$ and $W_{19}$–$W_{22}$ located at the right and left sides in the width direction of the warp knitted tape T are formed of a knitting structure stable dimensionally so as to suppress its stretch in a longitudinal direction of the tape T, and constitute an attachment area A to an attachment object. On the other hand, a warp knitted portion in a center of the tape T in the tape width except the attachment area A constitute a fastener-molding area B formed of a knitting structure having an appropriate stretching property in the longitudinal direction and some extent of stability in dimensional form.

The warp knitted tape T of this embodiment comprises four kinds of knitting yarns including chain stitch yarns 11 of 1-0/0-1 knitted over four wales $W_1$–$W_4$ and $W_{19}$–$W_{22}$ at the right and left sides in the width direction of the warp knitted tape T forming the aforementioned attachment area A, weft in-laid yarns 12 of 0-0/2-2 knitted in the attachment area A, two needle stitch yarns 13 of 0-2/2-0 knitted over the entire width of the warp knitted tape T and weft in-laid yarns 14 of 0-0/4-4 knitted over the entire width of the warp knitted tape T.

Specifically, in the aforementioned attachment area A to be attached to an attachment object, all the four kinds of knitting yarns 11–14 are knitted, while in the fastener-molding area B in which a fastener is to be molded, the two needle stitch yarns 13 and the weft in-laid yarns 14 of 0-0/4-4 are knitted. According to this embodiment, yarns thicker than the other yarns are used for a chain stitch yarn 11' to be disposed at the outermost sides of the warp knitted tape T. For example, when a single yarn composed of 100 d multi-filament is used for the other yarns, a single yarn of 200 d multi-filament or double yarns consisting of two yarns of 100 d is used for the chain stitch yarn 11' to be disposed at the outermost side of the warp knitted tape T. Of course, the present invention is not restricted to these thickness or fineness, but it is permissible to use yarns of various thickness depending on the attachment object to which it is applied.

Although mainly the knitting structure of 0-0/4-4 will be described as the weft in-laid yarn below, the weft in-laid yarn may be sometimes placed under 0-0/3-3 or 0-0/5-5 knitting structure. Therefore, the knitting structure should be restricted to a structure shown in the accompanying drawings.

In the embodiment shown in FIGS. 1 and 2, stretching property and stability in dimensional form in the warp direction are ensured in the warp knitted tape 10, based on the knitting structure as described above.

Generally., there is not so high stretching property in a direction in which a sinker loop extends in the warp knitting structure. Therefore, because the sinker loop of the chain stitch yarn 11 in the attachment area A to be disposed at both edge portions in the width direction of the warp knitted tape T extends in the warp direction along the wales in the aforementioned warp knitting structure, stretching property in the warp direction is suppressed most in that knitting structure. On the other hand, the two needle stitch yarns 13 of 0-2/2-0 to be knitted in the entire width of the warp knitted tape T are extended in zigzag shape both in the warp and weft directions over two wales and two courses of in which the sinker loops adjoin. Thus, the warp and weft sinkers suppress the stretching property both in the warp and weft directions of each other to some extent, thereby giving a feeling of woven fabric to the knitted fabric but stretching property in the warp direction is ensured as compared to a woven fabric.

Because the aforementioned weft in-laid yarn 12 of 0-0/2-2 to be disposed in only the attachment area A is disposed in the zigzag shape on each course over two wales. Therefore, the stretching property in the weft direction is suppressed more than that in the warp direction. Further, because the weft in-laid yarn 14 of 0-0/4-4 to be disposed in the entire width of the warp knitted tape T is knitted in, the stretching properties both in the warp and weft directions are fully suppressed in the attachment area A and the stability in dimensional form thereof is remarkably ensured, combined with the chain stitch yarn 11 and the two needle stitch yarn 13. Furthermore, because a yarn thicker than the other yarns is used for the chain stitch yarn 11' to be disposed in the wales $W_1$, and $W_{22}$ disposed at outermost side of the attachment area A, the dimensional stability in the weft direction is further enhanced.

On the other hand, because the fastener-molding area B composed of the wales $W_5$–$W_{18}$ are knitted with the-two needle stitch yarn 13 of 0-2/2-0 and the weft in-laid yarn 14 of 0-0/4-4, the stretching property in the weft direction is suppressed but the stretching property of the two needle stitch yarn 13 as the stretching property in the warp direction is much more increased as compared to that of the attachment area A. Further, the stretching property in the weft direction is suppressed sufficiently by the aforementioned weft in-laid yarn 14 of 0-0/4-4, and a feeling of a woven fabric composed of warp and weft yarns is entirely realized as a whole, so that some extent of stability in dimensional form can be ensured.

In the warp knitted tape T of this embodiment obtained in the above manner, the stretching property both in the warp and weft directions is entirely suppressed considerably in the attachment area A at the right and left edge portions of the tape T in the width direction so that the dimensional stability is excellent. In the fastener-molding area B located in the center on the other hand, flexibility as a warp knitted fabric, some extent of stretching property in the warp direction and stability in form are maintained.

When the fastening device with tape is manufactured with such a warp knitted tape T, for example, the production method for a fastener with tape (Japanese Patent Application No. 10-138722) as previously proposed by this inventor can be applied. Of course, as the production method, the methods as disclosed in the U.S. Pat. No. 2,821,764 and Japanese Patent Laid-Open Publication No. 62-155805 are also applicable. Further, another method for continuously producing a fastening device with tape is also applicable.

As for an ordinary production method for this kind of the fastening device with tape, for example, a long tape is supplied intermittently and fastener-mounting holes are formed at a predetermined pitch in the tape with a punch or the like. Then, the tape is inserted successively into a fastener-molding part of a molding die. As a result, a fastener of synthetic resin is molded integrally on front and rear surfaces of the tape including a periphery of the fastener-mounting hole such that the fastener-mounting hole is enclosed from inside.

Figure 3:
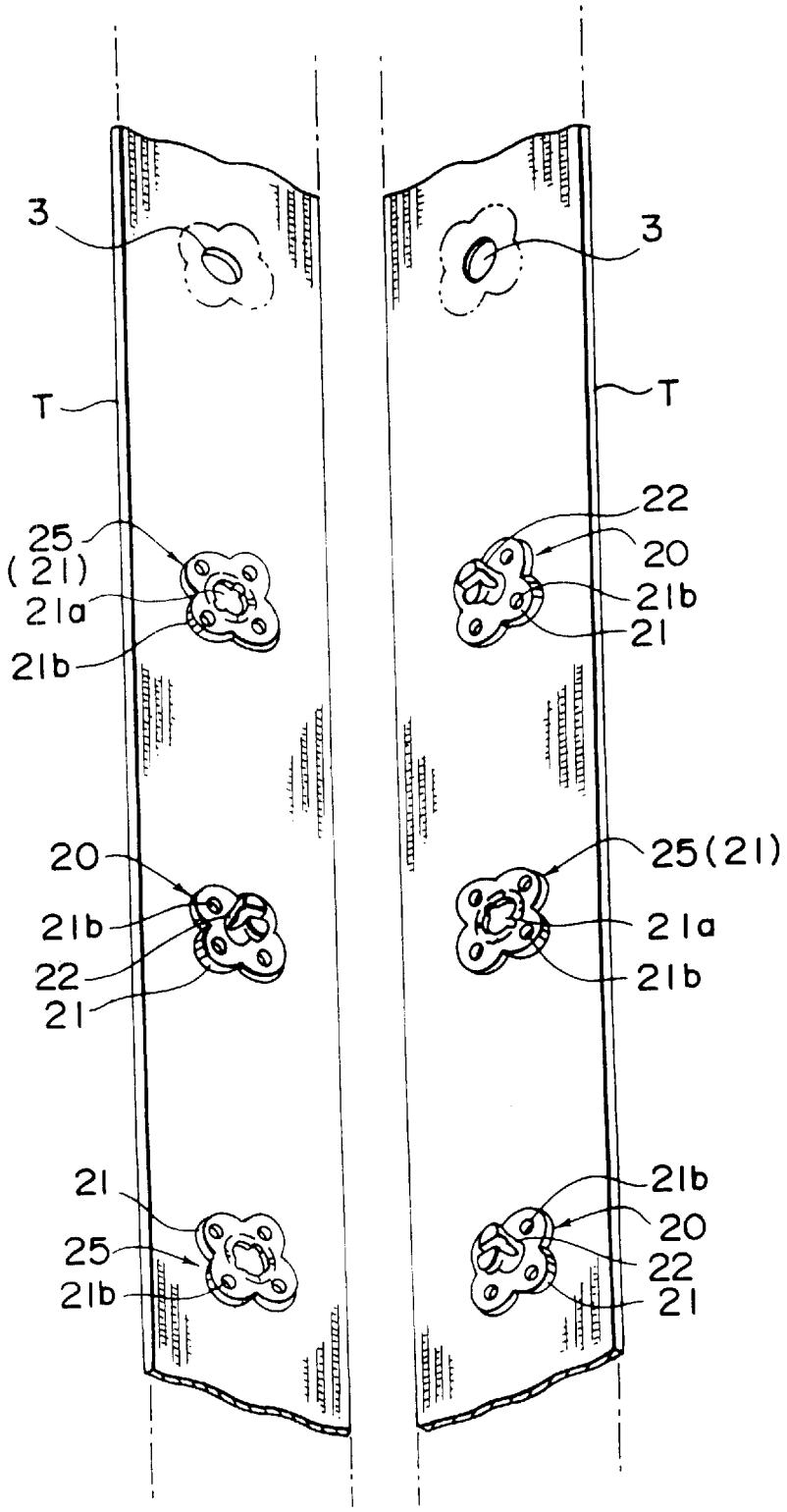
FIG. 3 is a perspective view of a snap fastener with tape showing an embodiment of the present invention.
Figure 4:
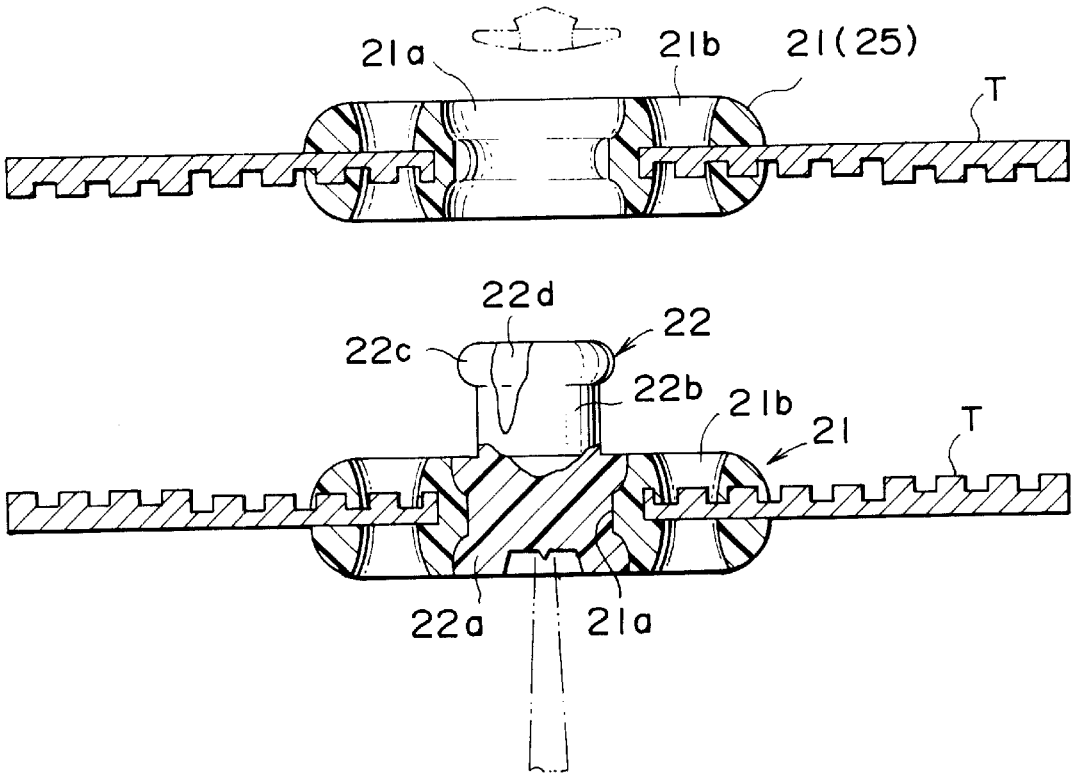
FIG. 4 is an enlarged sectional view showing an example of a structure of male and female snap fasteners in the fastening device with tape of the present invention.

FIGS. 3 and 4 show an example of a structure of a snap fastener with tape manufactured by the method according to the Japanese Patent Application No. 10-138722 as previously proposed by this inventor. As understood from the Figures, a male snap fastener 20 as a snap fastener with tape according to this embodiment comprises two members, i.e., a ring-like base member 21 and a male engaging member 22. The male engaging member 22 comprises a base portion 22*a* to be molded integrally so as to be fitted in an opening 21*a* of the base member 21, a column portion 22*b* erected from the base portion 22*a* and an engaging head portion 22*c* formed at a front end of the column portion 22*b*. According to the illustrated example shown here, the ring-like base member 21 has a structure which can be used as a female snap fastener 25 having on an inner peripheral face thereof an engaging surface for engaging and disengaging from the male snap fastener 20.

An external shape of the base member 21 entirely provides a flower-like shape in which four arc portions are connected with each other at their outer peripheries. The opening 21*a* is formed in the center of the base member 21. The mounting hole 3 of the tape T extends up to near the periphery of the opening 21*a* in the middle of the base member 21 in a direction of a thickness of the base member 21. The base member 21 is fixed integrally around the mounting hole 3 such that it encloses the periphery of the tape T around the mounting hole 3. According to this embodiment, likewise the aforementioned U.S. patent, four molding holes 21*b* are molded by clamping pins provided within the cavity and extending in the direction of the front/rear faces of the tape T. Each of the molding holes 21*b* is formed at a center of each arc portion such that its middle portion is crossed by the tape T.

Figure 5:
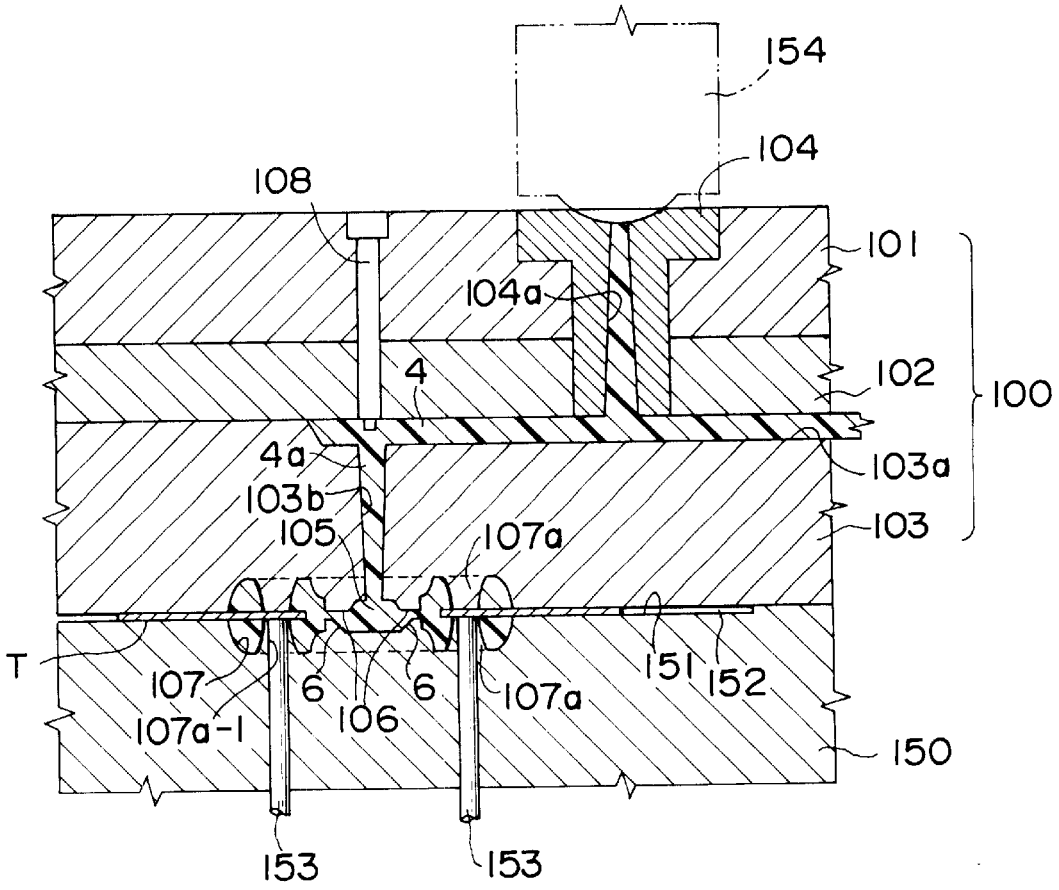
FIG. 5 is a sectional view showing an inside structure of a molding die, upon manufacturing, of a manufacturing apparatus for the female snap fastener with tape of the present invention.

FIG. 5 shows an example of a molding die for molding the ring-like base member 21 integrally on the tape T. According to this example, the molding die comprises a first die (movable die) 100 capable of moving vertically and a second die (fixed die) 150 disposed facing the first die 100. The first die 100 further comprises three plates 101 to 103 capable of moving vertically relative to each other. The upper plate 101 is a movable side mounting plate which is vertically movable with respect to a base frame by a lifting means (fluid pressure cylinder or the like) which is not illustrated. The middle plate 102 and the lower plate 103 are also movable vertically independently relative to the upper plate which is the movable side mounting plate 101. On the other hand, the second die 150 is composed of a single independent plate fixed on a machine base.

A substantially upper half portion of a sprue bush 104 for forming a sprue 104*a* is fixed in the movable side mounting plate 101 as in an ordinary method. A substantially lower half portion of the sprue bush 104 is slidably interfitted in a fitting hole in a stripper plate 102 which is the middle plate. A runner 103*a* communicating with the sprue 104*a* is formed in the lower plate 103 perpendicular to a transferring direction of the tape T. A sub-runner 103*b* extending vertically downward is formed at an end of the runner 103*a*. A runner lock pin 108 is mounted on an extension line of the sub-runner 103*b* in the movable side mounting plate 101 and the stripper plate 102. At a lower end of the sub-runner 103*b*, gates 106 extending horizontally via a resin reservoir portion 105 are formed on a partition surface 151 of the fixed die 150 which is the second die.

A front end portion of the gate 106 is connected to a molding cavity 107 for the base member 21 which is a female fastener. In the illustrated example, the molding cavity 107 is formed across the partition surface in the lower plate 103 and the fixed die 150 which is the second die. The resin reservoir portion 105 is also formed down to the fixed die 150. A tape-insertion passage 152 extending in the transferring direction (a direction perpendicular to a paper surface of FIG. 5) of the tape T is formed around the cavity 107 in the fixed die 150.

The base-member-molding cavity 107 is formed of a molding space of a flower shape having a substantially circular solid portion in the center thereof, with the gate 106 including the resin reservoir portion 105 being formed in the center as shown in FIG. 5. Four pairs of the pins 107*a* which are tape supporting members are disposed inside the ring-like space of the base member molding cavity 107 so as to protrude inward from above and below with a phase difference of 90°. A gap between each pair of upper and lower pins 107*a* is set at a dimension sufficient for clamping the tape T. According to this embodiment, an insertion hole for an eject pin 153 is formed in and through the pin 107*a* along an axis thereof facing the gate 106 of the fixed die 150. The eject pin 153 is slidable vertically in the pin 107*a* by an eject-pin-lifting means which is not illustrated here. Although the thickness of the tape T is indicated as being uniform in FIGS. 5 and 6, actually, the fastener-molding area B in the center is thin and the attachment area A at the right and left edge portions of the tape T is thick as shown in FIG. 4.

A procedure for manufacturing the tape with the base member by a molding apparatus having the molding die having such a structure will now be described. First, as described above, a long tape T is fed intermittently to a punching unit which is not illustrated here, while positioning of the tape T is carried out at every predetermined pitch. Then, the fastener-mounting holes 3 are formed successively at the punching unit. An injection molding unit having the aforementioned molding die is disposed adjacent the punching unit. The tape T in which the fastener-mounting holes 3 are formed is positioned such that a center of the fastener-mounting hole 3 coincides with the center of the base-member-molding cavity 107. Thus, the tape T is transferred to the injection molding unit synchronously with the punching unit.

Therefore, upon manufacturing of the tape with the base member, the positioning is carried out twice, that is, when a fastener-mounting hole 3 is formed in the long tape T being transferred and when the base member 21 is molded around the fastener-mounting hole 3. Although a high precision is required for this positioning as described above, a knitted tape having a normal stretching property is not capable of maintaining such a high positioning precision due to that stretching property. As a result, a slight displacement in position for each intermittent transfer of the tape to be processed finally leads to a large difference in position especially when the tape is long, so that a faulty product often occurs thereby disabling mass production of the same product.

However, according to the warp knitted tape T of the present invention having the above described knitting structure, in the attachment area A formed at both the right and left edge portions in the width direction of the tape T, the stretching properties in the warp and weft directions are suppressed as described above so as to ensure a dimensional stability. Therefore, no fault occurs even when a transfer system for ordinary woven tape is used as it is. As a result, a high precision is maintained regardless of the twice positionings as described above, so that no displacement is caused in the molding position of the base member 21 by continuous production of the long tape with the base member. Thus, mass production of such a tape is enabled.

The warp knitted tape T according to this embodiment is inserted into the tape-insertion passage 152 and positioned. After that, as shown in FIG. 5, with the entire die closed as shown in FIG. 5, an injection nozzle 154 of an injection apparatus is brought into contact with the sprue bush 104 and molten resin is injected. Then, molten resin is introduced through the sprue 104*a,* the runner 103*a,* the sub-runner 103*b,* the resin reservoir portion 105 and gate 106 into the base-member-molding cavity 107. Upon this injection of resin, the molten resin introduced into the cavity 107 flows from the front end of the gate 106 toward a periphery of the mounting holes 3 of the tape T. The molten resin is branched to the front and rear surfaces of the tape T so that it circulates around the upper/lower pins 107*a* disposed so as to face each other. Finally, the entire cavity is filled with the molten resin. At this time, the periphery of the tape T around the mounting hole 3 except a portion clamped by the pins 107*a* is buried integrally in the molten resin with a slight waving due to a fluid pressure of the resin.

When the injected resin is solidified by cooling, the movable side mounting plate 101 and the stripper plate 102 are raised together. With a molded runner 4 supported by the runner lock pin 108, it is disengaged from the lower plate 103 together with the molded sub-runner 4*a*. At this time, a bottom end of the molded sub-runner 4*a* is broken from an upper end of the molded resin reservoir portion 5 and separated therefrom. Next, the stripper plate 102 moves slightly so as to release the supporting of the molded runner 4 by the runner lock pin 108, thereby removing the molded runner from the molding die together with the molded sprue portion. After this disengagement is completed, the lower plate 103 moves upward so as to open the molding die. Substantially at the same time, the eject pins 153 move slightly upward so as to push up portions of the tape T exposed in the middles of the molding holes 21*b* in the supporting pins 107*a*. As a result, the base member 21 is pushed out of the molding die together with the molded gate 6. This operation is repeated so that the tapes T' with the base member are produced continuously.

Figure 6:
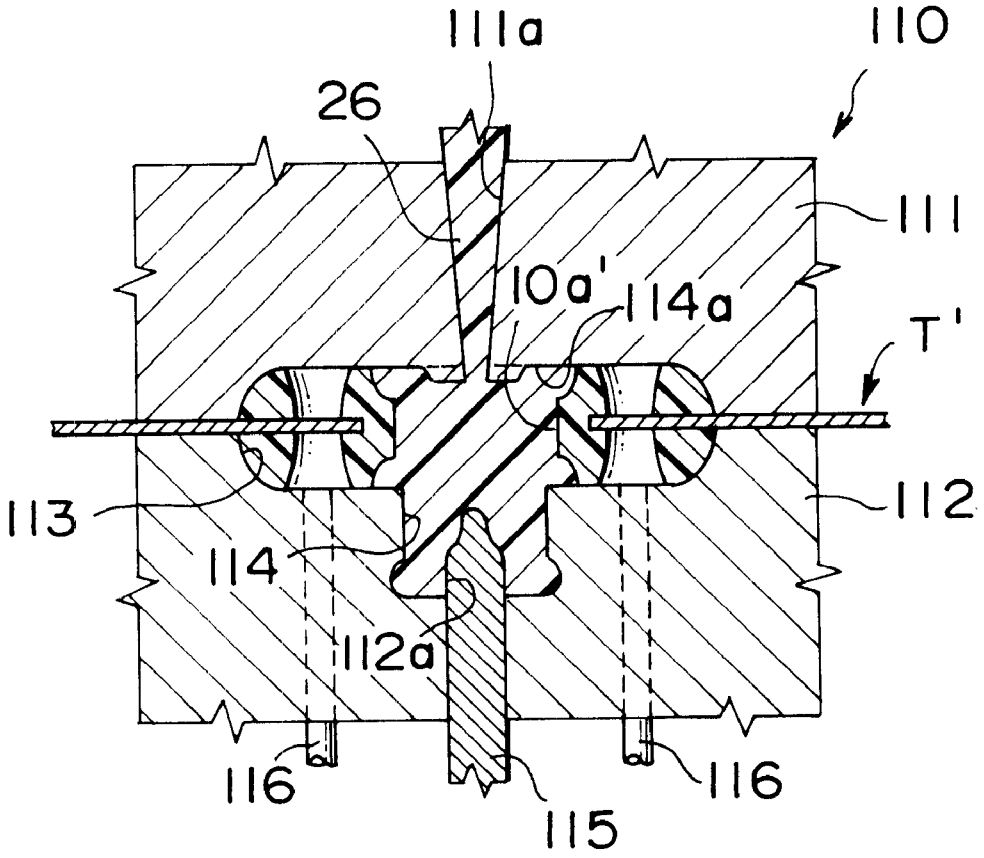
FIG. 6 is a sectional view showing an inside structure of a molding die, upon manufacturing the male snap fastener of the snap fastener with tape of the present invention.

FIG. 6 shows a major part of a molding die for integrally molding the male snap fastener 20 using the tape T' with the base member produced in the above manner. In the illustrated example, an engaging member 22 is formed integrally in a central opening of the base member 21 which is also a female snap fastener 25. In the Figure, an injection molding die 110 for molding a male fastener comprises a movable die 111 and a fixed die 112 likewise the injection molding die for molding the base member. In a parting face between the movable die 111 and the fixed die 112, an accommodating space portion 113 for the tape with the base member, which serves to tightly accommodate the base member 21 and the tape T, is formed. Further, the male-engaging-member-molding cavity 114 is formed in connection with the accommodating space 113 for the tape with the base member, in order to fill the central opening of the base member 21 with the base portion 22*a* and to form the column portion 22*b* and the engaging head portion 22*c*.

Thus, in the aforementioned movable die 111, a gate 111*a* communicating with a runner which is not illustrated here is formed so as to communicate with a central portion of a base-portion-molding portion 114*a* of the male-engaging-member-molding cavity 114. A sliding path 112*a* for a sliding core 115 for dividing the column portion 22*b* and the engaging head portion 22*c* into two sections is formed in the fixed die 112. The sliding path 112*a* is formed such that the sliding core 115 is capable of sliding in a direction intersecting the fixed die 112. Further, eject pins 116 which come into contact with an outer face of the base member 21 are provided in a portion for accommodating the base member 21 inside the tape-with-base-member-accommodating space 113 of the fixed die 112 such that the pins can be lifted up/down freely.

The tape T' with the base member is inserted into the injection molding die having such a structure and set therein. When the tape T' with the base member is inserted into the tape-with-base-member-accommodating space 113 formed in the movable die 111 and the fixed die 112 and the dies are closed, the molten resin is injected in a required injection quantity. The injected molten resin is introduced into the male-engaging-member-molding cavity 114 via the gate 111*a*. When the molten resin introduced into the male-engaging-member-molding cavity 114 is solidified by cooling, the movable die 111 is raised and then, the molded male engaging member 22 is separated from the molded gate 26 by fracture. At the same time as the movable die 111 begins to open the dies, the sliding core 115 is also actuated. When this sliding core 115 is removed from the molding cavity portion of the male engaging member 22, the eject pins 116 are actuated to push a male snap fastener 20 comprising the base member 21 and the male engaging member 21 out of the fixed die 112.

In the male snap fastener with the tape obtained in the above manner, the attachment area A at the edge portions in the width direction of the warp knitted tape T is attached along an edge of an opening/closing portion of clothes or the like, which is not illustrated here, by sewing. Upon this sewing, in the attachment area A, the stretching properties in the longitudinal direction and the width direction of the tape T are suppressed as described above, so that the dimensional stability is ensured. Thus, the sewing operation can be carried out smoothly. When the clothes on which the male snap fastener with the tape is, for example, a knitted garment having a proper stretching property as a knitted fabric, the fastener-molding portion B of the warp knitted tape T has some extent of stretching property based on the above knitting structure at least in the longitudinal direction of the tape T. Thus, when the engaging and disengaging operation is carried out with respect to a mating female snap fastener 25 with the tape by fingers, the warp knitted tape T follows stretch of the clothes excellently, so that a finger force is transmitted to the engaging portion easily. Therefore, the engaging/disengaging operation can be carried out smoothly and securely.

Figure 7:
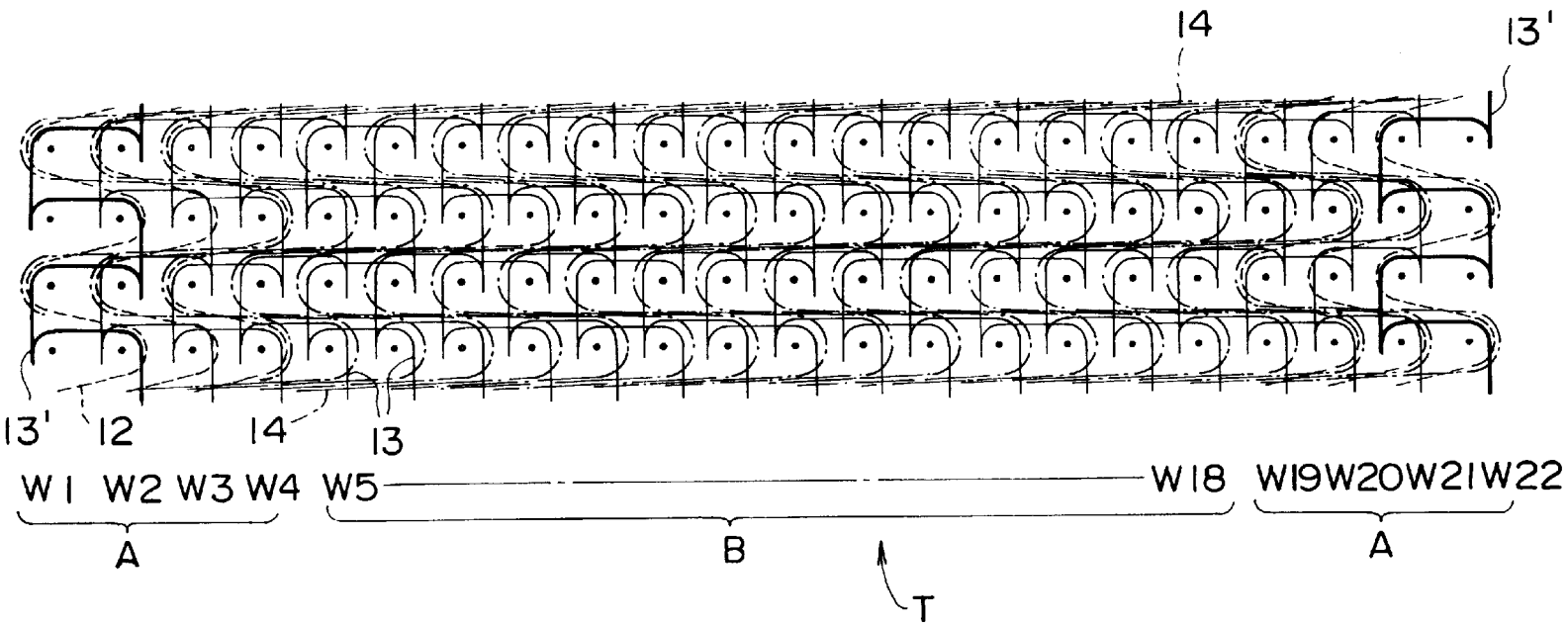
FIG. 7 is a diagram showing a knitting structure of other typical warp knitted tape applicable to the fastening device with tape of the present invention.

FIG. 7 shows an example of a second knitting structure of the warp knitted tape which can be applied to the fastening device with tape of the present invention. As understood from the Figure, this knitting structure is different from the first knitting structure shown in FIG. 1 in that the chain stitch yarns 11 are excluded from the four wales $W_1$–$W_4$ and $W_{19}$–$W_{22}$ at edge portions in the width direction of the warp knitted tape T and that a yarn thicker than the other yarns is used as the two needle stitch yarn 13 of 0-2/2-0 to be knitted in the respective two wales $W_1$, $W_2$ and $W_{21}$, $W_{22}$ at the edge portions in the width direction of the warp knitted tape T. The other knitting structure and the thickness of the other yarns are not essentially different from those shown in FIG. 1.

By applying such a knitting structure, the entire warp knitted tape T is comprised of the two needle stitch yarn 13 of 0-2/2-0 and the weft in-laid yarn 14 of 0-0/4-4. Further, in the attachment area A in which the weft in-laid yarn 12 of 0-0/2-2 is to be inserted, the thick two needle stitch yarn 13' having a larger thickness is respectively used for the outermost two wales, $W_1$, $W_2$ and $W_{21}$, $W_{22}$. As a result, in the attachment area A, particularly, the knitting density of the outermost two wales increases so that the stretching property in the warp direction decreases as compared to the other portions. At the same time, the stretching property in the weft direction is suppressed by the knitting structure of the weft in-laid yarn 12 of 0-0/2-2 and the two needle stitch yarn 13. Thus, the form of that portion is stabilized remarkably.

On the other hand, although a yarn as thick as the other structuring yarns is used for the third, fourth and 19th, 20th wales $W_3$, $W_4$ and $W_{19}$, $W_{20}$ which are the remaining wales of the above attachment area A, the weft in-laid yarns 12 of 0-0/2-2 are inserted, which is different from the fastener-molding area B. As a result, the form in the weft direction of the attachment area A is stabilized more than the fastener-molding area B. Therefore, although the stretching property in the warp direction decreases, some extent of the stretching property in the warp direction is ensured as compared to the outermost two wales $W_1$, $W_2$ and $W_{21}$, $W_{22}$.

In producing the male fastener with tape of the present invention using the warp knitted tape T having the above described knitting structure, the warp knitted tape T is transferred intermittently while it is positioned at the punching unit which is not illustrated here and the fastener-molding section which is not illustrated here as well the same time. At the same time, the positioning accuracy is secured likewise that of the ordinary woven tape so that the male snap fasteners 20 can be molded integrally at an accurate pitch in the longitudinal direction of the tape, because the two wales $W_1$, $W_2$ and $W_{21}$, $W_{22}$ at the outermost sides of the attachment area A of the warp knitted tape T have little stretching property in the warp direction. Further, the male fastening device with tape can be attached by sewing along an opening/closing portion of clothes smoothly. Furthermore, the two wales $W_3$, $W_4$ and $W_{19}$, $W_{21}$ disposed on inner side of the attachment area A at the right and left edge portions in the weft direction of the warp knitted tape T and all the wales $W_5$–$W_{18}$ in the above fastener-molding area B have a predetermined stretching property in the warp direction. Therefore, as for the engaging and disengaging operation with a mating female fastening device with tape, when the attachment object is flexible and has a stretching property, the warp knitted tape T follows a motion of the attachment object smoothly, so that operability by the fingers to the male and female snap fasteners 20, 25 and transmission of the finger force are improved so that the engaging and disengaging operation can be carried out easily and smoothly.

Figure 8:
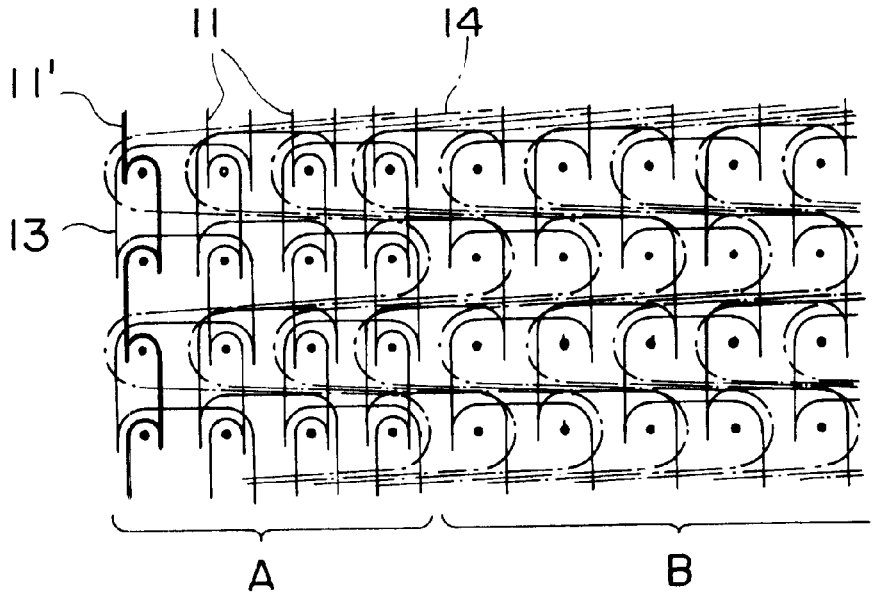
FIG. 8 is a diagram showing a knitting structure of still other typical warp knitted tape applicable to the fastening device with tape of the present invention.

FIG. 8 shows an example of a third knitting structure which can be applied to the fastening device with tape of the present invention. As understood from the Figure, this knitting structure is different from the first knitting structure shown in FIG. 1 in that the weft in-laid yarn 12 of 0-0/2-2 is excluded from the attachment area A at the right and left of the warp knitted tape T. The other knitting structure and the thickness of a yarn for use are not essentially different from those shown in FIG. 1.

By applying such a knitting structure, the entire warp knitted tape T is comprised of the two needle stitch yarn 13 of 0-2/2-0 and the weft in-laid yarn 14 of 0-0/4-4. In the attachment area A at both edge portions in which the chain stitch yarns 11, 11' of 1-0/0-1 are knitted, the aforementioned chain stitch yarn 11' is disposed wales $W_1$, $W_{22}$ at the outermost sides. Thus, in the same attachment area A, the knitting density of the wales $W_1$, $W_{22}$ at the outermost sides increases so that the stretching property thereof in the warp direction is suppressed more than the other portion of the attachment area A. Further, the stretching property in the weft direction is also suppressed by the two needle stitch yarn 13 and the weft in-laid yarn 14 of 0-0/4-4. As a result, the form of that portion is stabilized.

On the other hand, because the chain stitch yarns 11 exist in the three wales $W_2$–$W_4$, $W_{18}$–$W_{20}$, that is, second-fourth wales and 18th–20th wales which are the remaining wales in the attachment area A, the stretching property in the warp direction is suppressed more than the fastener-molding area B so that the form is stabilized. Further, the chain stitch yarns 11 may be excluded from the attachment area A. In that case, that portion is structured with the same knitting structure as the fastener-molding area B, so that in the attachment area A also, some extent of the form stability in the weft direction and the stretching property in the warp direction can be obtained likewise the fastener-molding area B.

In manufacturing a male fastening device with tape of the present invention, using the warp knitted tape T having such a knitting structure, accuracy of positioning which is carried out in the punching unit which is not illustrated here and the fastener-molding unit when the warp knitted tape T is transferred intermittently can be ensured, because the wale $W_1$, $W_{22}$ at the outermost side of the attachment area A of the warp knitted tape T has little stretching property in the warp direction. Further, the male fastener 20 can be molded integrally at an accurate pitch in the longitudinal direction of the tape. In this case, even when a yarn having some extent of stiffness is used for the outermost wales $W_1$, $W_{22}$ in the attachment area A, because a sewing line formed when the same warp knitted tape T is attached to the attachment object by sewing exists in the attachment area A on an inner side from the wale $W_1$, $W_{22}$ located at the outermost side, the fastening device with tape is hardly affected by the yarns used in the aforementioned outermost wales $W_1$, $W_{22}$ even after it is attached to the attachment object having stretching property. Thus, the device can follow a motion of the attachment object smoothly.

As for the engaging and disengaging operation for the fastening device with the warp knitted tape, the engagement and disengagement between the male snap fastener 20 and the female snap fastener 25 is facilitated. Further, like the above embodiment, a finger force can be transmitted to the snap fasteners 20, 25 securely so that an accurate, secure engaging/disengaging operation is enabled.

As evident from the above description, in the fastening device with the warp knitted tape T according to the present invention, the stretching property in the longitudinal direction of the tape T is suppressed in a part or all of the attachment area A formed on both edge portions in the width direction of the tape T. Therefore, upon manufacturing, a positioning accuracy in transferring the tape T can be secured and a production apparatus for the fastening device with tape, which is applicable to a conventional fabric, can be employed for manufacturing of the fastening device with tape according to the present invention.

When the fastening device with the warp knitted tape of the present invention manufactured in the above manner is attached to an attachment object such as clothes for example, having an ample stretching property, sewing work is facilitated because part or all of the attachment area A to the clothes is not so stretchable. Further, upon engaging/disengaging operation after the attachment to the clothes, because the fastener-molding area B between the sewing lines has some extent of the stretching property, the area stretch locally together with the clothes when a local external stress is applied to the molding area B of the tape T,. As a result, handling of the fastening device with the fingers is facilitated. Further, because a finger force is transmitted accurately to the fastening device, an accurate, secure engagement and disengagement can be carried out.

What is claimed is:

1. A fastening device with tape obtained by molding at least one fastener such as a snap fastener made of thermoplastic synthetic resin integrally on front and rear surfaces of a tape, characterized in that said tape is composed of a warp knitting structure in which plural wales are disposed in a width direction of the tape, an area formed of one or more wales disposed at right and left edge portions in the width direction of the tape is an attachment area to an attachment object, an area formed of plural wales in a center in the width direction of the tape is a fastener-molding area, said attachment area has a knitting structure stabilized in dimensional form while stretch thereof in a warp direction of the tape are suppressed, and said fastener-molding area has a knitting structure having a required stretching property in the warp direction of the tape and some extent of stability in dimensional form.

2. A fastening device with tape according to claim 1, characterized in that said warp knitted tape is entirely composed of a knitting structure formed by tangling of a two needle stitch yarn and a weft in-laid yarn, and a chain stitch yarn is knitted in said attachment area.

3. A fastening device with tape according to claim 2, characterized in that a yarn thicker than the other yarns is used for the chain stitch yarn disposed at an outermost wale in said attachment area.

4. A fastening device with tape according to claim 1, characterized in that said warp knitted tape is entirely composed of a knitting structure formed by tangling of a two needle stitch yarn and a weft in-laid yarn, and a yarn thicker than the other yarns is used for the two needle stitch yarn disposed at outermost wales in said attachment area.

5. A fastening device with tape according to any one of claims 2 through 4, characterized in that a weft in-laid yarn is inserted in zigzag shape in the warp direction on two wales in said attachment area.

* * * * *